United States Patent [19]

Getty et al.

[11] Patent Number: 5,055,218

[45] **Date of Patent: * Oct. 8, 1991**

[54] BLEACH GRANULES CONTAINING AN AMIDOPEROXYACID

[75] Inventors: Edward E. Getty, Cincinnati, Ohio; Kathleen B. Hunter, Villa Hills, Ky.; Eugene S. Sadlowski, Cincinnati, Ohio

[73] Assignee: The Procter & Gamble Company, Cincinnati, Ohio

[ * ] Notice: The portion of the term of this patent subsequent to Mar. 20, 2007 has been disclaimed.

[21] Appl. No.: 508,994

[22] Filed: Apr. 13, 1990

[51] Int. Cl.[5] ..... C11D 3/395; C11D 7/54; C11D 9/42; A62D 9/00

[52] U.S. Cl. ..... 252/94; 252/95; 252/98; 252/102; 252/186.23

[58] Field of Search ..... 252/94, 95, 98, 102, 252/186.23

[56] References Cited

U.S. PATENT DOCUMENTS

| | | | |
|---|---|---|---|
| 3,956,159 | 5/1976 | Jones . | |
| 4,100,095 | 7/1978 | Hutchins et al. . | |
| 4,126,573 | 11/1978 | Johnston . | |
| 4,170,453 | 10/1979 | Kitko . | |
| 4,259,201 | 3/1981 | Cockrell, Jr. et al. . | |
| 4,287,135 | 9/1981 | Stober et al. . | |
| 4,325,828 | 4/1982 | Postlethwaite . | |
| 4,529,534 | 7/1985 | Richardson . | |
| 4,634,551 | 1/1987 | Burns et al. | 252/102 |
| 4,686,063 | 8/1987 | Burns . | |
| 4,818,425 | 4/1989 | Meijer et al. . | |
| 4,909,953 | 3/1990 | Sadlowski et al. | 252/99 |

FOREIGN PATENT DOCUMENTS

| | | |
|---|---|---|
| 0200163 | 4/1986 | European Pat. Off. . |
| 0201958 | 11/1986 | European Pat. Off. . |
| 0238341 | 9/1987 | European Pat. Off. . |

*Primary Examiner*—Paul Lieberman
*Assistant Examiner*—William S. Parks
*Attorney, Agent, or Firm*—Kathleen M. Harleston; Donald E. Hasse; Thomas H. O'Flaherty

[57] ABSTRACT

This is a bleach granule comprising the nonylamide of peroxyadipic acid with a average particle size of about 0.1 to 260 microns, bleach-stable surfactant, and a hydratable, NAPAA-compatible material, e.g. sodium sulfate. The bleach granules are stable and are effective bleaching agents.

16 Claims, No Drawings

BLEACH GRANULES CONTAINING AN AMIDOPEROXYACID

TECHNICAL FIELD

This invention relates to a bleach granule for soft or hard water laundering comprising the nonylamide of peroxyadipic acid with an average particle size of from about 0.1 to 260 microns.

BACKGROUND OF THE INVENTION

Organic peroxyacids are useful as fabric bleaching agents but are highly reactive compounds of limited storage stability. One such organic peroxyacid is the nonylamide of peroxyadipic acid ("NAPAA"). A problem encountered during development of NAPAA was its low AvO, or available oxygen, in a hard water wash solution. Not all of the NAPAA dissolves when detergent with bleach granules (including NAPAA) is added to the wash water. Surprisingly, by keeping the mean particle size of the crystallitic NAPAA less than about 260 microns, solubility of NAPAA is improved, even when the NAPAA crystals are incorporated in bleach granules before addition as part of a detergent or bleach composition to the wash water. It is believed that this is because the small NAPAA crystals do not complex easily with the calcium ions in hard water washes.

It has also been found that better thermal stability is achieved if boric acid is not added to the NAPAA, even though exotherm control agents, such as boric acid, are normally added to organic peroxyacids during synthesis to prevent an exotherm reaction.

It has also been found that additional chelants are not necessary to achieve a stable bleach granule where the NAPAA has been phosphate buffer washed.

The following patents and patent applications disclose information known about NAPAA and/or peracid particle size. U.S. Pat. No. 4,259,201, Cockrell, Jr. et al, issued Mar. 31, 1981 discloses granular detergent compositions containing organic peroxyacids which are buffered to a pH of 8.5–8.6 in water of about 2 grains hardness and no less than about 8 in water of about 14 grains hardness, preferably by using boric acid.

U.S. Pat. No. 4,126,573, Johnston, issued Nov. 21, 1978 discloses improved peroxyacid bleaching particles comprising an inner core of a solid peroxyacid compound and as a coating a surfactant compound. Methods of making and using such particles and compositions containing such particles are also described. The amount of surfactant used to coat the peroxyacid particles is from about 5 to 100% based on the weight of the peroxyacid. The coated particles have a particle diameter of from about 1 to 150 microns, preferably about 5 to 100 microns.

U.S. Pat. No. 4,818,425, Meijer et al, issued Apr. 4, 1989 discloses a process for preparation of agglomerates containing diperoxydodecanedioic acid (DPDA) and a water-impermeable material, e.g. lauric acid. The process comprises the successive steps of (1) agitating an aqueous suspension of the diperoxy acid in the presence of the water-impermeable material and above the melting point thereof, (2) cooling the suspension of the agglomerated particles thus obtained to a temperature at which the water-impermeable material turns solid, and (3) isolating the resulting agglomerates. According to Meijer et al, the greatest dimension of the suspended DPDA particles should be in the range of 0.5 to 100 microns, preferably 0.5 to 50 microns.

U.S. Pat. No. 4,634,551, Burns et al, issued Jan. 6, 1987, discloses bleaching compounds and compositions comprising fatty peroxyacids, salts thereof, and peroxyacid precursors having amide moieties in the fatty acid chain. NAPAA and NAPSA are included.

U.S. Pat. No. 4,686,063, Burns, issued Aug. 11, 1987, discloses fatty peroxyacids, or salts thereof, having amide moieties in the fatty chain and low levels of exotherm control agents. Control of the exotherms of NAPAA and NAPSA with boric acid are included (see column 10).

U.S. Pat. No. 4,909,953, Sadlowski et al, issued Mar. 20, 1990, discloses the use of a phosphate buffer wash for improved amide peroxyacid storage stability. Example I concerns NAPSA and Example III discusses NAPAA.

European Pat. No. Application 0 238 341, discloses a granular bleach activator composition containing an organic binder which has improved low temperature release properties by incorporating a water-soluble granule disintegration aid, usually a sequestering agent. A process for producing the granules is also provided. According to page 11, the activator should be provided in the form of small particles generally having an average particle size in the range of 50–500 microns, preferably 100–300 microns. The particulate binder preferably has an average particle size below 200 microns, generally below 100 microns, and is preferably free of particles above 200 microns in size. The granules preferably have an average particle size of 300–1500 microns, preferably 500–1000 microns.

SUMMARY OF THE INVENTION

This invention relates to a bleach granule for hard or soft water laundering, comprising:

(a) from about 5 to 70 weight % nonylamide of peroxyadipic acid ("NAPAA") with an average particle size of from about 0.1 to 260 microns;

(b) from about 1 to 40 weight % bleach-stable surfactant selected from the group consisting of anionics, nonionics, ampholytics, zwitterionics and combinations thereof; and (c) from about 10 to 95 weight % hydratable, NAPAA-compatible material.

Preferred for use in the bleach granules is NAPAA which has been contacted with a phosphate buffer solution with a pH between about 3.5 and 6.0. It is preferred that additional chelants (in the case of phosphate buffer washed NAPAA) and boric acid not be added to the NAPAA or bleach granule.

Included herein is a method of laundering in hard or soft water comprising washing fabrics with a granular detergent composition comprising from 0.5 to 50 weight % of the present bleach granules. Also included is a method of bleaching fabric in hard or soft water, comprising contacting fabrics with a bleaching composition comprising from about 10 to 100 weight % of the present bleach granules.

DESCRIPTION OF THE INVENTION

The present invention concerns a bleaching granule, preferred for inclusion in a conventional detergent composition, which includes three ingredients: the nonylamide of peroxyadipic acid ("NAPAA"), bleach-stable surfactant, and a hydratable, NAPAA-compatible material. The average particle size of the crystallitic NAPAA used in the bleaching granule is restricted to between 0.1 and 260 microns, but preferably 1 to 160 microns, to increase the amount of effective bleach which is in the wash solution and thereby improve bleaching/cleaning of fabrics in the wash. This is particularly useful in a hard water wash, i.e. wash water with more than about 6 grains of hardness, because hardness, specifically calcium ions, has been seen to interfere with available oxygen (AvO) from NAPAA with larger particle size. While not meaning to be bound by theory, it is believed that the calcium ions in the hard water surround large NAPAA particles, i.e. greater than about 300 microns, and interfere with the dissolution of the NAPAA, and that the smaller (about 0.1–260 microns) NAPAA particles dissolve rapidly in the wash water with minimal interference from the hardness ions.

I. NAPAA

Another name for the nonylamide of peroxyadipic acid ("NAPAA") is 6-(nonylamino)-6-oxo-caproic acid. The chemical formula for NAPAA is:

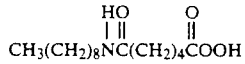

$$CH_3(CH_2)_8\overset{\overset{\displaystyle HO}{|}}{N}C\overset{\overset{\displaystyle O}{\|}}{(CH_2)_4}COOH$$

The molecular weight of NAPAA is 287.4.

Detergent compositions and bleaching compositions containing NAPAA provide extremely effective and efficient surface bleaching of textiles. Stains and/or soils are removed from the textiles. These compositions are particularly effective at removing dingy soils from textiles. Dingy soils are soils that build up on textiles after numerous cycles of usage and washing, and thus, result in a white textile having a gray or yellow tint. These soils tend to be blends of particulate and greasy materials. The removal of this type of soil is sometimes referred to as "dingy fabric clean up".

The present compositions provide such bleaching over a wide range of bleach solution temperatures. Such bleaching is obtained in bleach solutions wherein the solution temperature is at least about 5° C. Inorganic peroxygen bleaches would be ineffective and/or impracticable at temperatures below about 60° C.

NAPAA's polar amide or substituted amide moiety results in a peroxyacid which has a very low vapor pressure and thus possesses a low odor profile as well as excellent bleaching performance. It is believed that the polarity of the amide group results in a reduction of vapor pressure of the peroxyacid, and an increase in melting point.

NAPAA can be used directly as a bleaching agent. It has a reduced vapor pressure and a good odor profile in laundry applications.

NAPAA can be prepared by, for example, first reacting NAAA (monononyl amide of adipic acid), sulfuric acid, and hydrogen peroxide. The reaction product is quenched by addition to ice water followed by filtration, washing with distilled water, and final suction filtration to recover the wet cake. Washing can be continued until the pH of the filtrate is neutral.

Small particle size NAPAA crystals are desired herein. Preferably, these small NAPAA crystals are recovered by quenching in ice water with high shear applied, e.g. rapid stirring, during addition of the NAPAA solution to water. Other known means of achieving small particle size may be used as appropriate. The NAPAA is then rinsed with water to remove excess sulfuric acid. The average particle size of the NAPAA crystals herein is 0.1 to 260 microns and is in large part a function of the amount of shear applied. Even better solubility in harder water can be achieved, though, with a NAPAA average particle size of between about 1 and 160 microns. More preferred is from about 5 to 100 microns and most preferred is from about 10 to 90 microns. It is believed that the present smaller particle size would improve NAPAA solubility in most aqueous applications in addition to a laundry application. It is surprising that a benefit in hard water is seen even where these small NAPAA particles are incorporated into a larger bleach granule. These bleach granules are added to a bleaching composition or detergent composition which is added to the wash water in a laundering application.

It is highly preferred that the NAPAA particles be stabilized by washing with a phosphate buffer (pH 3.5–6.0, preferably 4–5). The phosphate buffer is preferably comprised of orthophosphates or pyrophosphates or combinations thereof in a concentration range of from about 0.01M to about 1M. The NAPAA wet cake is preferably placed in enough phosphate buffer to cover it, stirred for a period of time sufficient to assure thorough contact, and then filtered. See U.S. Pat. No. 4,909,953, Sadlowski et al, issued Mar. 20, 1990, incorporated herein. The NAPAA filter cake is preferably washed again in the phosphate buffer. It has been found that two successive phosphate buffer washes lend optimal stability to NAPAA. It is also highly preferred that the NAPAA pH (10% solids in water) be between about 4.2 and 4.75. Surprisingly, this pH results in more thermally stable particles.

The bleach granules herein comprise from about 5 to 70, preferably 10 to 65, most preferably 20 to 60 weight % NAPAA.

II. Bleach-Stable Surfactant

The bleach granules of this invention also include from about 1 to 40 weight % bleach-stable detergent surfactant selected from the group consisting of anionics, nonionics, zwitterionics and ampholytics and combinations thereof. From about 2 to 25 weight % bleach-stable detergent surfactant is preferred and about 5 to 15 weight % is most preferred. Anionic surfactant is preferred and salts of $C_{11-13}$ linear alkyl benzene sulfonate and/or $C_{12-16}$ alkyl sulfate are more preferred. Sodium $C_{12-13}$ linear alkyl benzene sulfonate is most preferred.

Detergent surfactants useful herein are listed in U.S. Pat. Nos. 3,664,961, Norris, issued May 23, 1972, and 3,919,678, Laughlin et al, issued Dec. 30, 1975, both incorporated herein by reference. The following are representative examples of detergent surfactants useful in the present compositions.

Water-soluble salts of the higher fatty acids, i.e., "soaps", are useful anionic surfactants in the compositions herein. This includes alkali metal soaps such as the sodium, potassium, ammonium, and alkylammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11-13}$LAS.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Water-soluble nonionic surfactants are also useful in the compositions of the invention. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched configuration, with from 3 to 12 moles of ethylene oxide per mole of alkyl phenol.

Preferred nonionics are the water-soluble and water-dispersible condensation products of aliphatic alcohols containing from 8 to 22 carbon atoms, in either straight chain or branched configuration, with from 3 to 12 moles of ethylene oxide per mole of alcohol. Particularly preferred are the condensation products of alcohols having an alkyl group containing from about 9 to 15 carbon atoms with from about 4 to 8 moles of ethylene oxide per mole of alcohol.

Semi-polar nonionic surfactants include water-soluble amine oxides containing one alkyl moiety of from about 10 to 18 carbon atoms and two moieties selected from the group of alkyl and hydroxyalkyl moieties of from about 1 to about 3 carbon atoms; water-soluble phosphine oxides containing one alkyl moiety of about 10 to 18 carbon atoms and two moieties selected from the group consisting of alkyl groups and hydroxyalkyl groups containing from about to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms.

III. Hydratable NAPAA-Compatible Material

The bleach granules herein also comprise from about 10 to 95 weight % hydratable, NAPAA-compatible material. The material preferably has a pH below about 8.0, most preferably below about 7.0. These can be selected from the group consisting of sodium sulfate, sodium acetate, sodium perborate, sodium phosphate, sodium acid phosphite, lithium formate, lithium sulfate, zinc nitrate, and combinations thereof.

Preferred is sodium sulfate (most preferred) and hydratable phosphate, e.g. the monobasic salt of phosphate. Also preferred is from about 20 to 70, most preferably 30 to 50, weight % of the above hydratable, NAPAA-compatible material. Materials to be avoided contain heavy metals such as iron and halides.

The approximate hydration temperatures of some of these materials are given below:

| | |
|---|---|
| Sodium acetate | 136° F. |
| Sodium phosphate | 94 |
| Sodium perborate | 104 |
| Sodium acid phosphite | 108 |
| Sodium sulfate | 90 |

These hydratable materials are useful in processing the bleach granules of this invention and they add integrity to the final bleach granule. An appropriate method for forming these bleach granules is described in U.S. Pat. No. 4,091,544, Hutchins, issued May 30, 1978, incorporated herein. That process involves allowing the mixture to be formed into spherical particles, flakes, ribbons or other desired configuration. The chosen forms are then cooled to a temperature sufficiently low so that the hydratable material is hydrated. To remove the unwanted waters of hydration and free water the material is heated to a temperature which allows the water to be driven off but will not cause the forms to soften and stick together. This process allows for the elimination of the need for further size reduction and the associated dust. Other known methods of forming granules or agglomerates may be used as appropriate.

An additional surprising discovery is that boric acid, an exotherm control agent, should not be added to the NAPAA before addition to the bleach granule if improved thermal stability is desired. It was found in U.S. Pat. No. 4,686,063, Burns, issued Aug. 11, 1987, incorporated herein, that peroxygen bleaching compounds can be stabilized by addition of exotherm control agents, particularly boric acid. We have found that for the present NAPAA-containing bleach granules when incorporated in a granular detergent composition, leaving out boric acid results in improved thermal stability when compared to the same granules containing boric acid. This difference in stability is marked in bleach granules comprising about 25 weight % NAPAA. It is therefore preferred herein not to include boric acid in the NAPAA/bleach granules.

It has also been found that the present bleach granules are stable in detergent compositions even without the addition of chelants (other than the residual phosphate which may remain from the preferred buffer wash). Chelants are known to combine with metal ions present and thus help to prevent decomposition of peroxyacids which can be catalyzed by heavy metals. Chelants have been described in, for example, U.S. Pat. No. 4,909,953, Sadlowski et al, issued Mar. 20, 1990, incorporated herein. Examples of such chelants, which are optionally not included herein, are: carboxylates, such as ethylene diamine tetraacetate (EDTA) and diethylene triamine pentaacetate (OTPA); polyphosphates, such as sodium acid pyrophosphate (SAPP), tetrasodium pyrophosphate (TSPP), and sodium tripolyphosphate (STPP); phosphonates, such as ethylhydroxydiphosphonate (Dequest® 2010) and other sequestering agents sold under the Dequest® trade name; dipicolinic acid, picolinic acid, and 8-hydroxyquinoline, and combinations thereof.

The bleach granules herein are effective bleaching agents and are stable in solution and in product, especially in preferred form, i.e. without boric acid or additional chelants, and where NAPAA has been phosphate buffer washed and brought to a pH between about 3.5 and 6 before addition to the bleach granule.

The bleach granules herein are preferably included in a granular detergent composition or bleaching composition. The preferred granular detergent composition comprises from about 0.5 to 50, preferably 5 to 25, weight % bleach granules according to the above description, from about to 30 weight % detergent surfactant, which is described above, and from about 10 to 60 weight % detergency builder. The bleaching composition preferably comprises from about 10 to 100 weight % of the present bleach granules.

Water-soluble inorganic or organic electrolytes are suitable detergency builders. The builder can also be water-insoluble calcium ion exchange materials; nonlimiting examples of suitable water-soluble, inorganic detergent builders include: alkali metal carbonates, borates, phosphates, bicarbonates and silicates. Specific examples of such salts include sodium and potassium tetraborates, bicarbonates, carbonates, orthophosphates, pyrophosphates, tripolyphosphates and metaphosphates.

Examples of suitable organic alkaline detergency builders include: (1) water-soluble amino carboxylates and aminopolyacetates, for example, nitrilotriacetates, glycinates, ethylenediaminetetraacetates, N-(2-hydroxyethyl)nitrilodiacetates and diethylenetriaminepentaacetates; (2) water-soluble salts of phytic acid, for example, sodium and potassium phytates; (3) water-soluble polyphosphonates, including sodium, potassium and lithium salts of ethane-1-hydroxy-1, 1-diphosphonic acid; sodium, potassium, and lithium salts of ethylene diphosphonic acid; and the like; (4) water-soluble polycarboxylates such as the salts of lactic acid, succinic acid, malonic acid, maleic acid, citric acid, carboxymethyloxysuccinic acid, tartrate mono- and disuccinates (ether linked), oxydisuccinate, 2-oxa-1,1,3-propane tricarboxylic acid, 1,1,3,2-ethane, tetracarboxylic acid mellitic acid and pyromellitic acid; and (5) water-soluble polyacetals as disclosed in U.S. Pat. Nos. 4,144,266 and 4,246,495, incorporated herein by reference.

Another type of detergency builder material useful in the present compositions comprises a water-soluble material capable of forming a water-soluble reaction product with water hardness cations preferably in combination with a crystallization seed which is capable of providing growth sites for said reaction product. Such "seeded builder" compositions are fully disclosed in British Pat. No. Specification No. 1,424,406.

A further class of detergency builder materials useful in the present invention are insoluble sodium aluminosilicates, particularly those described in U.S. Pat. No. 4,605,509, issued Aug. 12, 1986, incorporated herein by reference. The detergent compositions of this invention can contain all of the usual components of detergent compositions including the ingredients set forth in U.S. Pat. No. 3,936,537, Baskerville et al, incorporated herein by reference. Such components include color speckles, suds boosters, suds suppressors, antitarnish and/or anticorrosion agents, soil-suspending agents, soil-release agents, dyes, fillers, optical brighteners, germicides, alkalinity sources, hydrotropes, antioxidants, enzymes, enzyme stabilizing agents, perfumes, etc. A more complete disclosure of suitable enzymes can be found in U.S. Pat. No. 4,101,457, Place et al, issued July 18, 1978, incorporated herein by reference.

Also included in the present invention is a method of laundering in hard or soft water, comprising washing fabrics with a granular detergent composition comprising from 0.5 to 50, preferably 5 to 25, weight % bleach granules according to the above description, from about to 30 weight % detergent surfactant as described above, and from about 10 to 60 weight % detergency builder as described above.

Lastly, a method of bleaching fabrics in hard or soft water, comprising contacting fabrics with a bleaching composition comprising from about 10 to 100 weight % of the subject bleach granules is also included.

The following nonlimiting examples illustrate the process and compositions of the present invention.

All parts, percentages and ratios herein are by weight unless otherwise specified.

EXAMPLE I

A freshly-prepared sample of NAPAA (monononyl amide of peroxyadipic acid) wet cake is obtained which typically consists of approximately 66.33% water, 1.75% peroxyacid available oxygen (AvO) (corresponding to 31.42% amide peroxyacid, and the rest (2.25%) unreacted starting material). This wet cake is the crude reaction product of NAAA (monononyl amide of adipic acid), sulfuric acid, and hydrogen peroxide which is subsequently quenched by addition to ice-water followed by filtration, washing with distilled water, and final suction filtration to recover the wet cake. Washing is continued until the pH of the filtrate is neutral. A 10% weight/volume (w/v) slurry of wet cake (10 g wet cake solids in 100 ml distilled water) has a pH of 2.6. A portion of wet cake is then air-dried to obtain a dry sample which consists of 5.19% AvO (corresponding to 93.2% NAPAA) and 8.8% unreacted starting material. Portions of the wet cake are then subjected to the following treatments. Phosphate buffers are made by mixing 0.10 M (moles/liter) solutions of NaH2PO4, Na2HPO4, and Na3PO4 to achieve the desired pH.

Batch (A) consists of a portion of the wet cake which is dried at room temperature. When dry, the sample pH is (as a 10% w/v slurry in distilled water) 2.6. Malvern particle size analysis reveals that the average amide peroxyacid particle size is 282.20 microns and the median particle size is 268.41 microns.

Batch (B) consists of 20.0 g of wet cake which was washed with 1 liter of phosphate buffer (0.10M, pH=4.50) and then air-dried overnight at room temperature. When dry, the sample pH is 4.49. Malvern particle size analysis reveals that the average amide peroxyacid particle size is 67.30 microns and the median particle size is 51.42 microns.

The samples of NAPAA dry wet cake are then tested for solubility and solution stability. The peroxyacid may be added to the solution as a solid for determining the solubility of the peroxyacid or solution runs may also be performed using predissolved samples in order to study peroxyacid decomposition.

Solution AvO content is measured by iodometric titration with sodium thiosulfate. The solution experiments are conducted in a flask filled with 4 liters of water (containing an appropriate concentration of hardness ion, typically a 3:1 molar ratio of calcium to magnesium ions) and the temperature of the water is adjusted to the desired temperature. Typical screening temperature is 95° F. Other temperatures used are 65° F. and 125° F. Next all components of the solution mixture are added to the flask (components include peroxyacid, detergent (see below), and sodium carbonate). For predissolved runs the peroxyacid is dissolved in methanol and added as a solution. When the peroxyacid is added, the run has started (i.e., T=0). Samples are then drawn from the flask and quenched (with iced acetic acid) at T=1, 2, 3, 5, 8, and 12 minutes. After all samples are taken, a potassium iodide solution is added to each sample. The resulting brown/yellow color is titrated to colorless with sodium thiosulfate.

The composite of the spray-dried non-phosphate detergent granule is:

| | Weight % |
|---|---|
| C11-13 linear alkyl benzene sulfonate | 13.6 |
| C14-15 alkyl sulfate | 5.7 |
| Zeolite | 30.7 |
| Sodium carbonate | 25.0 |
| Sodium polyacrylate | 4.5 |
| Silicate (2.0r) | 4.5 |
| Sodium sulfate, moisture, and miscellaneous | 16.0 |
| Total | 100.0 |

Results are expressed below in terms of percent theoretical maximum available oxygen (AvO) in solution; as a function of time. The samples used for the following experiments are as follows:

Sample #1 consists of 0.193 grams of NAPAA dried wet cake (Batch A is air-dried overnight at room temperature). The sample pH (as a 10% w/v slurry in distilled water) is 2.60.

Sample #2 consists of 0.190 grams of NAPAA dried wet cake is washed with phosphate buffer (0.10M, pH=4.50) then air-dried overnight (Batch B). The sample pH=4.49.

Sample #3 consists of 0.193 grams of NAPAA dried wet cake (Batch A) predissolved in 10 ml of methanol.

| Sample No. | Particle Size In Microns | Temp. | Hardness In Grains/ Gallon (gpg) | Percent of Theoretical Maximum AvO Present In Solution Versus Time In Minutes | | | | | |
|---|---|---|---|---|---|---|---|---|---|
| | | | | 1 | 2 | 3 | 5 | 8 | 12 |
| 1 | Avg. = 282.20 | 95° F. | 0 | 12 | 20 | 32 | 52 | 68 | 84 |
| | Median = 268.41 | | 6 | 4 | 12 | 12 | 24 | 44 | 60 |
| | | | 12 | 0 | 0 | 0 | 0 | 0 | 0 |
| 2 | Avg. = 67.30 | 65° F. | 0 | 33 | 36 | 48 | 56 | 68 | 76 |
| | Median = 51.42 | | 6 | 16 | 20 | 28 | 32 | 39 | 48 |
| | | | 12 | 38 | 31 | 32 | 35 | 42 | 52 |
| | | 95° F. | 0 | 51 | 62 | 68 | 82 | 86 | 90 |
| | | | 6 | 52 | 62 | 68 | 69 | 84 | 85 |
| | | | 12 | 17 | 26 | 23 | 27 | 32 | 58 |
| | | 125° F. | 0 | 84 | 91 | 94 | 91 | 104 | 88 |
| | | | 6 | 52 | 66 | 92 | 90 | 94 | 91 |
| | | | 12 | 48 | 52 | 53 | 54 | 70 | 66 |
| 3 | Predis- | 65° F. | 0 | 92 | 92 | — | 106 | 114 | 94 |
| | solved | | 6 | 98 | 108 | 95 | 102 | 98 | 92 |
| | | | 12 | 92 | 95 | 92 | 92 | 88 | 78 |
| | | 95° F. | 0 | 100 | 100 | 100 | 96 | 96 | 92 |
| | | | 6 | 92 | 92 | 92 | 92 | 91 | 90 |
| | | | 12 | 91 | 85 | 84 | — | 87 | 84 |
| | | 125° F. | 0 | 96 | 96 | 100 | 90 | 89 | 89 |
| | | | 6 | 96 | 92 | 86 | 108 | 98 | 88 |
| | | | 12 | 88 | 87 | 104 | 88 | 80 | 62 |

As can be seen from the data above, the dissolution rate and solution stability of NAPAA in the presence of calcium and magnesium ions is dependent on particle size. For NAPAA, a small particle size results in faster dissolution and a higher final solution AvO which is similar to the predissolved sample. When NAPAA is predissolved in methanol it can be observed that only minimal losses in AvO occur (84% recovery at 95° F. and 12 gpg) compared to large particle size NAPAA (0% recovery at 95 F and 12 gpg). Laundry cleaning also is best with #3 and #2 is better than #1.

EXAMPLE II

This example shows the improved storage stability for small particle size NAPAA wet cake which has been buffer washed and granulated for incorporation into a granular detergent composition.

Sample #1 of granulated NAPAA wet cake (having an average particle size of 282.20 microns and a median diameter of 268.41 microns after water washing) is prepared by combining the following:

| | |
|---|---|
| 2.740 g | dried NAPAA wet cake (described in Example #1, Batch A) |
| 1.370 g | boric acid |
| 1.099 g | linear alkyl benzene sulfonate paste |
| 5.362 g | sodium sulfate |
| 0.012 g | tetrasodium pyrophosphate |
| 0.006 g | dipicolinic acid |
| 2.159 g | water |

All ingredients are thoroughly mixed and then the granules are formed by passing the mixture through a # 18 Tyler mesh plastic sieve followed by air-drying overnight at room temperature. When dry, the granules (which include 25% NAPAA, boric acid, and chelants) prepared in this manner had a pH=4.33 (measured as a 10% weight/volume slurry in distilled water).

Sample #2 of granulated NAPAA wet cake (having an average particle size of 93.03 microns and a median diameter of 41.38 microns after phosphate buffer washing) is prepared by combining all of the same ingredients in identical proportions. The granulation is then carried out as for Example #1. Sample #2 (which includes 25% NAPAA, boric acid, and chelants) have a pH=4.55 after drying.

Sample #3 of granulated NAPAA wet cake (having an average particle size of 93.03 microns and a median diameter of 41.38 microns after buffer washing) is prepared by combining the following:

| | |
|---|---|
| 2.740 g | dried NAPAA wet cake |
| 0.549 g | linear alkyl benzene sulfonate paste |
| 7.010 g | sodium sulfate |
| 2.376 g | water |

All ingredients are thoroughly mixed and then the granules are formed by passing the mixture through a #18 Tyler mesh plastic sieve followed by drying. When dry, the granules (which contain 25% NAPAA, boric acid, and chelants) prepared in this manner have a pH=4.63 (measured as a 10% weight/volume slurry in distilled water).

Portions of the granulated samples (16% for Samples #1 & #2, 8% for Sample #3) are combined with a non-phosphate detergent (see Example #1) granule (84% for Samples #1 & #2, 92% for Sample #3) and are placed in open containers at 80° F.(26.7° C.), 100° F. (37.8° C.), and 120° F.(48.9° C.) for storage stability testing.

Results are expressed below in terms of percent peroxyacid available oxygen (AvO) remaining as a function of time at 120° F. temperature.

| Sample No. | Boric Acid/ Chelants | Particle Size In Microns | Percent of Initial AvO Remaining After 8 Weeks |
|---|---|---|---|
| 1 | Yes | Avg. = 282.20 | 61 |
| 2 | Yes | Avg. = 93.03 | 78 |
| 3 | No | Avg. = 93.03 | 89 |

Thus, the use of a small particle size amidoperoxyacid in conjunction with a buffer wash can result in an increase in in-product peroxyacid stability. A greater increase in in-product stability can be obtained when boric acid and chelants are removed from the granule (Sample No. 3).

EXAMPLE III

This example shows the improved dissolution rate and solution stability for small particle size NAPAA wet cake which has been granulated for incorporation into a granular detergent composition.

Sample #1 Same as Sample #1, Example II.

Sample #2 Same as Sample #2, Example II.

Sample #3 of granulated NAPAA wet cake (having an average particle size of 93.03 microns and a median diameter of 41.38 microns after buffer washing) is prepared by combining the following:

| | |
|---|---|
| 5.480 g | dried NAPAA wet cake |
| 0.549 g | linear alkyl benzene sulfonate paste |
| 4.270 g | sodium sulfate |
| 2.376 g | water |

All ingredients are thoroughly mixed and then the granules are formed by passing the mixture through a #18 Tyler mesh plastic sieve followed by drying. When dry, the granules (which include 50% NAPAA, no boric acid, and no chelants) have a pH=4.63 (measured as a 10% weight/volume slurry in distilled water).

The samples of NAPAA granules are then tested for solubility and solution stability as in Example #1. Results are expressed below in terms of percent theoretical maximum available oxygen (AvO) in solution as a function of time:

| Sample No. | Particle Size In Microns | Temp. | Hardness In Grains/ Gallon (gpg) | Percent of Theoretical Maximum AvO Present In Solution Versus Time In Minutes | | | | | |
|---|---|---|---|---|---|---|---|---|---|
| | | | | 1 | 2 | 3 | 5 | 8 | 12 |
| 1 | Avg. = 282.20 | 95° F. | 0 | 96 | 100 | 92 | 88 | 88 | 90 |
| 25% | | | 6 | 80 | 84 | 76 | 76 | 76 | 72 |
| | | | 12 | 68 | 72 | 64 | 52 | 48 | 48 |
| 2 | Avg. = 93.03 | 65° F. | 0 | 90 | 90 | 103 | 91 | 90 | 94 |
| 25% | | | 6 | 76 | 84 | 94 | 94 | 112 | 98 |
| | | | 12 | 80 | 76 | 82 | 82 | 80 | 81 |
| | | 95° F. | 0 | 92 | 89 | 92 | 88 | 93 | 94 |
| | | | 6 | 86 | 86 | 84 | 82 | 80 | 81 |
| | | | 12 | 77 | 77 | 79 | 76 | 72 | 72 |

-continued

| Sample No. | Particle Size In Microns | Temp. | Hardness In Grains/ Gallon (gpg) | Percent of Theoretical Maximum AvO Present In Solution Versus Time In Minutes 1 | 2 | 3 | 5 | 8 | 12 |
|---|---|---|---|---|---|---|---|---|---|
| | | 125° F. | 0 | 94 | 88 | 88 | 88 | 98 | 83 |
| | | | 6 | 88 | 86 | 82 | 82 | 82 | 76 |
| | | | 12 | 78 | 76 | 84 | 62 | 71 | 62 |
| 3 | Avg. = 93.03 | 65° F. | 0 | 94 | 100 | 95 | 94 | 93 | 95 |
| 50% | | | 6 | 74 | 88 | 97 | 95 | 104 | 100 |
| | | | 12 | 72 | 80 | 70 | 72 | 76 | 76 |
| | | 95° F. | 0 | 92 | 92 | 98 | 99 | 100 | 100 |
| | | | 6 | 89 | 91 | 98 | 90 | 94 | 104 |
| | | | 12 | 67 | 71 | 72 | 74 | 79 | 69 |
| | | 125° F. | 0 | 73 | 93 | 96 | 92 | 88 | 84 |
| | | | 6 | 88 | 84 | 84 | 84 | 84 | 83 |
| | | | 12 | 78 | 71 | 84 | 58 | 64 | 60 |

Thus, small particle size NAPAA incorporated into granules leads to increased solution AvO recovery and leads to a decrease in the NAPAA sensitivity to hardness ions (i.e. calcium and/or magnesium ions) in the wash. These smaller bleach particles also exhibit better dingy clean up in laundry performance testing.

EXAMPLE IV

A sample of NAPAA wet cake made as described in Example #1 which has been stabilized by washing with a phosphate buffer (0.10M,pH=4.5) is used in the following manner. The NAPAA wet cake (having an average particle size of 67.30 microns and a median diameter of 51.42 microns after buffer washing) is granulated by combining with the following ingredients:

| | Weight % |
|---|---|
| NAPAA dried wet cake | 54.8% |
| Linear alkyl benzene sulfonate (paste) | 5.0% |
| Sodium sulfate | 40.2% |

The granules are formed by passage through a #18 Tyler mesh plastic sieve and are air-dried overnight.

The bleach granules are then admixed with a spray dried granular detergent to provide a finished bleach detergent composition having the following composition.

| | Weight % |
|---|---|
| C11-13 linear alkyl benzene sulfonate | 12.4 |
| C14-15 alkyl sulfate | 5.2 |
| Zeolite | 27.9 |
| Sodium carbonate | 22.8 |
| Sodium polyacrylate | 4.1 |
| Silicate (2.0r) | 4.1 |
| Bleach granules | 9.0 |
| Sodium sulfate, moisture, and miscellaneous | 14.5 |

These bleach-containing detergent compositions are effective bleaching and cleaning compositions.

EXAMPLE V

A sample of NAPAA wet cake made as described in Example #1 which has been stabilized by washing with a phosphate buffer (0.10M,pH=4.5) is used in the following manner. The NAPAA wet cake (having an average particle size of 67.30 microns and a median diameter of 51.42 microns after buffer washing) was granulated by combining with the following ingredients:

| | Weight % |
|---|---|
| NAPAA dried wet cake | 54.8% |
| Linear alkyl benzene sulfonate (paste) | 5.0% |
| Sodium sulfate | 40.2% |

The granules are formed by passage through a #18 Tyler mesh plastic sieve and are air-dried overnight.

The bleach granules are then admixed with a spray dried granular detergent to provide a finished bleach detergent composition having the following composition.

| | Weight % |
|---|---|
| C11-13 linear alkyl benzene sulfonate | 12.9 |
| C14-15 alkyl sulfate | 5.4 |
| Zeolite | 29.0 |
| Sodium carbonate | 23.6 |
| Sodium polyacrylate | 4.3 |
| Silicate (2.0r) | 4.3 |
| Bleach granules | 5.5 |
| Sodium sulfate, moisture, and miscellaneous | 15.0 |

These bleach-containing detergent compositions are effective bleaching and cleaning compositions.

EXAMPLE VI

A sample of NAPAA wet cake made as described in Example #1 which has been stabilized by washing with a phosphate buffer (0.10M,pH=4.5) is used in the following manner. The NAPAA wet cake (having an average particle size of 67.30 microns and a median diameter of 51.42 microns after buffer washing) is granulated by combining with the following ingredients:

| | Weight % |
|---|---|
| NAPAA dried wet cake | 27.4% |
| Linear alkyl benzene sulfonate (paste) | 5.0% |
| Sodium sulfate | 67.7% |

The granules are formed by passage through a #18 Tyler mesh plastic sieve and are air-dried overnight.

The bleach granules are then admixed with a spray dried granular detergent to provide a finished bleach detergent composition having the following composition.

| | Weight % |
|---|---|
| C11-13 linear alkyl benzene sulfonate | 12.1 |
| C14-15 alkyl sulfate | 5.1 |
| Zeolite | 27.3 |
| Sodium carbonate | 22.3 |
| Sodium polyacrylate | 4.0 |
| Silicate (2.0r) | 4.0 |
| Bleach granules | 11.0 |
| Sodium sulfate, moisture, and miscellaneous | 14.2 |

These bleach-containing detergent compositions are effective bleaching and cleaning compositions.

EXAMPLE VII

A sample of NAPAA wet cake made as described in Example #1 which has been stabilized by washing with a phosphate buffer (0.10M,pH=4.5) is used in the following manner. The NAPAA wet cake (having an average particle size of 67.30 microns and a median diameter of 51.42 microns after buffer washing) is granulated by combining with the following ingredients:

| | Weight % |
|---|---|
| NAPAA dried wet cake | 36.2% |
| Linear alkyl benzene sulfonate (paste) | 5.0% |
| Sodium sulfate | 58.8% |

The granules are formed by passage through a #18 Tyler mesh plastic sieve and are air-dried overnight.

The bleach granules are then admixed with a spray dried granular detergent to provide a finished bleach detergent composition having the following composition.

| | Weight % |
|---|---|
| C11-13 linear alkyl benzene sulfonate | 12.5 |
| C14-15 alkyl sulfate | 5.2 |
| Zeolite | 28.2 |
| Sodium carbonate | 22.9 |
| Sodium polyacrylate | 4.1 |
| Silicate (2.0r) | 4.1 |
| Bleach granules | 8.3 |
| Sodium sulfate, moisture, and miscellaneous | 14.7 |

These bleach-containing detergent compositions are effective bleaching and cleaning compositions.

What is claimed is:

1. A bleach granule for hard or soft water laundering, comprising:

(a) from about 5 to 70 weight % nonylamide of peroxyadipic acid ("NAPAA") with an average particle size of from about 0.1 to 260 microns;

(b) from about 1 to 40 weight % bleach-stable surfactant selected from the group consisting of anionics, nonionics, ampholytics, zwitterionics and combinations thereof; and (c) from about 10 to 95 weight % hydratable, NAPAA-compatible material;

wherein additional chelants are not added to the NAPAA or the bleach granule, and wherein neither NAPAA nor the bleach granule contain boric acid.

2. A bleach granule for hard or soft water laundering according to claim 1 wherein the NAPAA has been contacted with a phosphate buffer solution with a pH between about 3.5 and 6.0.

3. A bleach granule for hard or soft water laundering according to claim 2 wherein the phosphate buffer solution is comprised of orthophosphates or pyrophosphates or combinations thereof in a concentration range of from about 0.10M to 1M.

4. A bleach granule for hard or soft water laundering according to claim 3 wherein the NAPAA has been washed twice with the phosphate buffer solution and the NAPAA pH after washing is between about 4.2 and 4.75.

5. A bleach granule for hard or soft water laundering according to claim 1, wherein the bleach-stable surfactant is an anionic surfactant.

6. A bleach granule for hard or soft water laundering according to claim 2 wherein the hydratable, NAPAA-compatible material is sodium sulfate.

7. A bleach granule for hard or soft water laundering according to claim 3 wherein the average particle size of the NAPAA is from about 1 to 160 microns.

8. A bleach granule for hard or soft water laundering according to claim 7 wherein the bleach-stable surfactant is a salt of $C_{11-13}$ linear alkyl benzene sulfonate.

9. A bleach granule for hard or soft water laundering according to claim 4 wherein the average particle size of the NAPAA is from about 5 to 100 microns.

10. A bleach granule for hard or soft water laundering according to claim 4 wherein the bleach granule comprises from about 10 to 65 weight % of the NAPAA, from about 2 to 25 weight % sodium $C_{11-13}$ linear alkyl benzene sulfonate, and from 20 to 70 weight % sodium sulfate.

11. A bleach granule for hard or soft water laundering according to claim 4 wherein the bleach granule consists essentially of:

(a) from 20 to 60 weight % NAPAA with a average particle size of from about 5 to 100 microns;

(b) from 5 to 15 weight % sodium $C_{12-13}$ linear alkyl benzene sulfonate; and (c) from 30 to 50 weight % sodium sulfate.

12. A granular detergent composition comprising from about 0.5 to 50 weight % bleach granules according to claim 1, from about 1 to 30 weight % detergent surfactant, and from about 10 to 60 weight % detergency builder.

13. A method of laundering in hard or soft water, comprising washing fabrics with a granular detergent composition comprising from 0.5 to 50 weight % bleach granules according to claim 1; from about 1% to about 30% detergent surfactant; and from about 10% to about 60% of detergency builder.

14. A method of laundering in hard or soft water, comprising washing fabrics with a granular detergent composition comprising from 5 to 25 weight % bleach granules according to claim 4; from about 1% to about 30% detergent surfactant; and from about 10% to about 60% of detergency builder.

15. A method of laundering in hard or soft water, comprising washing fabrics with a granular detergent composition comprising from 5 to 25 weight % bleach granules according to claim 11; from about 1% to about 30% detergent surfactant: and from about 10% to about 60% of detergency builder.

16. A method of bleaching fabric in hard or soft water, comprising contacting fabrics with a bleaching composition comprising from about 10 to 100 weight % bleach granules according to claim 1.

* * * * *